United States Patent [19]

Hagiwara et al.

[11] 4,084,752

[45] Apr. 18, 1978

[54] GAP ADJUSTING SYSTEM FOR CRUSHER AND METHOD

[75] Inventors: Tatsuo Hagiwara, Funabashi; Fumihiro Nomiyama, Chiba; Shigenori Nagaoka, Funabashi, all of Japan

[73] Assignee: Kawasaki Jukogyo Kabushiki Kaisha, Japan

[21] Appl. No.: 741,952

[22] Filed: Nov. 15, 1976

[30] Foreign Application Priority Data

Dec. 11, 1975 Japan ..... 50-147800
May 17, 1976 Japan ..... 51-55264

[51] Int. Cl.[2] ..... B02C 13/26

[52] U.S. Cl. ..... 241/30; 241/37; 241/241

[58] Field of Search ..... 241/30, 33, 37, 189 R, 241/189 A, 239–241, 286

[56] References Cited

U.S. PATENT DOCUMENTS

| | | | |
|---|---|---|---|
| 3,035,782 | 5/1962 | Burbank | 241/37 X |
| 3,292,869 | 12/1966 | Beyeler | 241/37 |
| 3,637,145 | 1/1972 | Williams | 241/189 A |
| 3,944,146 | 3/1976 | Stockmann et al. | 241/30 |

FOREIGN PATENT DOCUMENTS

| | | | |
|---|---|---|---|
| 841,600 | 5/1970 | Canada | 241/37 |

*Primary Examiner*—Roy Lake
*Assistant Examiner*—Howard N. Goldberg

[57] ABSTRACT

A system and method for adjusting a gap between rotary striking blades or hammers and an operating plate in a crusher without interrupting the operation thereof are disclosed. In one embodiment, the system includes a sensing bar provided on a slider, a shifting device for the slider, a moving device for the operating plate and a controlling device electrically connected to motors of the slider and the moving device. In operation, the sensing bar is brought into contact with the rotating striking blades or hammers by shifting the slider, whereby detecting the extent of wear of the striking blades or hammers from the total shifting distance of the slider, and the operating plate is then moved to the extent commensurate with the detected wear.

9 Claims, 3 Drawing Figures

GAP ADJUSTING SYSTEM FOR CRUSHER AND METHOD

BACKGROUND OF THE INVENTION

This invention relates to a system for adjusting a gap between striking blades or hammers and an operating plate without interrupting the crushing operation in a crusher or a crushing-drying machine, and to a method therefor.

An impact or hammer crusher or a crushing-drying machine, in general, is attended with a problem that striking blades or hammers attached to the periphery of a rotor suffer wear during operation, and an inceased grain size of crushed pieces is bound to result. Particularly when it is desired to obtain crushed pieces having a mean diameter as fine as 20 mm, the circumferential speed of the rotor must be increased. This incurs the severe wear of the striking blades or hammers, resulting in an increased grain size of crushed pieces with the progress of time, with the failure to produce products of a desired grain size range.

To cope with this, such procedures have been commonly taken that when it is found that a grain size of crushed pieces exceeds a given grain size range, the crushing operation is immediately interrupted. The casing is then examined through a viewing opening for measuring the extent of wear of the striking blades or hammers, and the operating plate opposing the rotor is manually or mechanically moved towards the rotor to an extent commensurate with the extent of wear of the striking blade or hammer, thereby adjusting the crushing gap between the striking blades or hammers and the operating plate. The necessity to adjust a gap by interrupting the crushing operation occasionally arises. Moreover, in a crushing-drying machine in which a hot gas blast is blown for drying purposes, adjustment of the gap can not be started until the machine has cooled down. This is time consuming. Thus, the conventional adjusting procedure is inefficient and lowers productivity.

SUMMARY OF THE INVENTION

The present invention provides a system amd method for adjusting a gap between striking blades or hammers and an operating plate in a crusher without interrupting the supply of a material to be crushed and rotation of the striking blades or hammers. The steps involved in the method include bringing a wear detecting means into contact with the rotating striking blades or hammers, thereby detecting the extent of wear of the striking blades or hammer; converting the extent of wear of the striking blades or hammers, thus detected, into an extent of displacement of an operating plate toward the striking blades or hammers; and moving the operating plate toward the striking blades or hammers by the extent thus converted.

The system of the present invention includes a device for detecting the extent of wear of the striking blades or hammers; a device for converting the extent of wear, thus detected, into an extent of displacement of an operating plate; and a device for moving said operating plate.

In one preferred embodiment, the system of the present invention includes;

a sensing means capable of undergoing an action of the rotating striking blades or hammers during service;

a means for shifting said sensing means towards the striking blades or hammers, said shifting means including a slider on which is disposed said sensing means, a ball screw threaded with said slider, and a first motor for turning said ball screw;

a means for converting the extent of shift of said shift means into a displacement of the operating plate; and, a means for moving the operating plate including a connecting rod connected at one end to said operating plate, a slider supporting the other end of said connecting rod, a ball screw threaded with said slider, and second motor for turning said ball screw; said first and second motors, respectively, being electrically connected to said converting means.

It is accordingly an object of the present invention to provide a system and method for adjusting a gap between the striking blades or hammers and an operating plate in a crusher, without stopping the crusher.

It is another object of the present invention to provide a system and method for adjusting a gap between the striking blades or hammers and an operating plate in a crusher, which is capable of producing crushed pieces having a grain size in the range of a given, optimum grain size range throughout a long period of service.

BRIEF DESCRIPTION OF THE DRAWING

The foregoing and other objects, features and advantages of this invention will best be understood from the following detailed description of an exemplary embodiment of the invention taken in conjunction with the accompanying drawing, in which.

DESCRIPTION OF THE PREFERRED EMBODIMENTS

Figure 1:
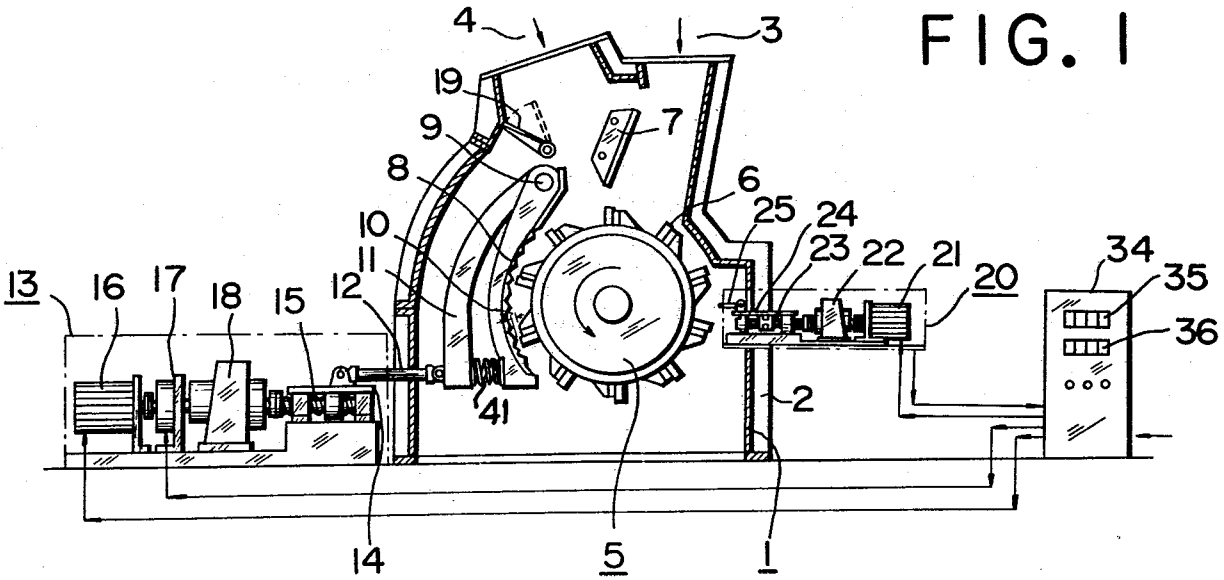
FIG. 1 is a vertical longitudinal view, partially in cross-section, diagrammatically showing a crushing-drying machine embodying the present invention.

Referring to FIG. 1, shown generally at 1 is a crushing-drying machine having a casing 2. In the upper portion of the casing 2 are provided a material supplying opening 3 and a drying gas feeding port 4. Disposed substantially in the central portion of the casing 2 is a rotor 5, on the periphery of which a plurality of striking blades 6 are replaceably mounted.

Shown at 7 is an impact which is located above the rotor and is useful for guiding the material to the operating plate, and at 8 the operating plate which is carried in suspended fashion by a pin 9, which in turn is rigid with the casing. In order to maintain a gap between the tips of respective striking blades 6 and the operating plate 8 within a predetermined range 10, there is provided a connecting rod 12 which is rigid at one end thereof with an arm 11 supporting the operating plate 8 and which has its other end projecting to the exterior of the casing 2 and coupled to a means 13 for moving the operating plate 8. Between arm 11 and plate 8 is a damper spring 41.

The means 13 for moving the operating plate includes a slider 14 for supporting the other end of the connecting rod 12, a ball screw 15 threaded with the slider 14, a motor 16 for rotating the ball screw 15, a reduction gear 18 disposed between the motor 16 and the ball screw 15, and an electromagnetic brake 17. The rotary shaft of the motor 16 is connected through the mediary of the electromagnetic brake 17 to the reduction gear 18, to the driven side of which is connected one end of the ball screw 15. Thus, the gap between the tips of the striking blades and the operating plate 8 will be adjusted through rotation of the motor 16 within the desired range 10.

Designated 19 is a changing-over damper, by which streams of drying gas fed through the port 4 join together on the back side of the operating plate so as to heat said plate, thereby preventing adhesion of crushed pieces to said operating plate 8.

A means 20 for detecting the extent of wear of the striking blades 6 is disposed on the other side of the casing 2 and includes a motor 21, a reduction gear 22, a slider 24 and a sensing portion 25. The shaft of the motor 21 is connected through the mediary of the reduction gear 22 to a ball screw 23, which in turn is threaded with the slider 24. Thus, rotation of the motor 21 causes the shift of the slider 24.

Figure 2:
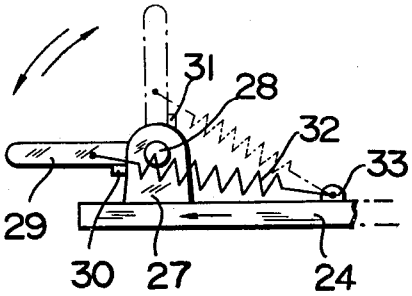
FIG. 2 is an enlarged fragmentary vertical view of wear detecting portion of the present invention.

Referring to FIG. 2 showing an example of the sensing portion 25, a support plate 27 is disposed upright on one end portion of the slider 24, and a sensing bar 29 is pivotally supported at one end by a pin 28, which in turn is attached to the support plate 27 in the upper portion thereof. The support plate 27 has a stopper 31 and a contacting switch 30. The sensing bar 29 is adapted to be pivotally turned through about 90° between the stopper 31 and the switch 30. A spring 32 is fastened at one end to the mid portion of the sensing bar 29, extending beyond the pin 28 and eventually secured at the other end onto the slider by means of a hook 33.

An electrically controlling device 34 includes a portion 35 for indicating the extent of wear, which is so arranged that the number of pulses generating when the motor 21 is rotated is digitally indicated as a length of advance of the slider 24. The electrically controlling device 34 further includes a crushing gas determining portion 36, which is so arranged as to determine a given value of the crushing gap between the striking blades 6 and the operating plate 8.

The electrically controlling device 34, the electromagnetic brake 17 and the motor 16 are electrically connected in the manner shown in FIG. 1.

In operation, prior to starting the crushing, a reference point for the slider 14 and that for the slider 24 are predetermined in a manner that the length of shift of the slider 14 which advances from the point of stopper serving as a reference point towards the rotor 5 for moving the operating plate 8 toward the impact plates 6 for adjustment of the crushing gap 10 is equal to the length of the shift of the slider 24 which advances from the stopper point towards the rotor 5, with the sensing bar 29 maintained in the horizontally inverted position as shown by a solid line in FIG. 2, until the tip of the sensing bar 29 contacts the tips of the striking blades 6.

In starting the crushing, the optimum gap 10 is provided between the striking blades 6 and the operating plate 8, with the slider 24 maintained in a retracted position, and the rotor 5 is operated. Then, material to be crushed is continuously supplied through the supply opening 3 into the casing 2, whereby the material thus supplied is crushed into pieces of a given grain size. The crushing in this machine is effected by giving the impact of the impact plates 6, to the material being crushed, making the material being crushed collide with one another, impinging the material on the impact plate 7, and subjecting the material being crushed to the crushing and grinding between the striking blades 6 and the operating plate 8. It is customary to use an operating plate short in length. Use of the elongated operating plate as shown in the drawing contributes to lengthening the duration of the crushing step. For drying the material being crushed, a hot gas blast is fed through the inlet port 4. With the progress of the crushing, the tips of the striking blades 6 suffer wear, resulting in an increased grain size of crushed pieces. Before a grain size of crushed pieces exceeds the given range of grain size, the procedure for detecting the extent of wear should be taken for compensation, without interrupting the supply of the material being crushed into the casing as well as rotation of the rotor 5. To this end, it is necessary to set a given gap value on the crushing gap setting portion 36 beforehand. If the sensing bar 29 is turned to a horizontal position, then the switch 30 is rendered "on." With this condition maintained intact, current is fed to the pulse motor 21, whereby the slider 24 is advanced towards the rotor. The extent of shift of the slider 24 towards the rotor is indicated on the indicating portion 35. The instant the tip of the sensing bar 29 contacts the tips of the striking blades 6 attached to the rotating rotor 5, the sensing bar 29 is sprung towards the vertical position until it impinges on the stopper 31, and at the same time, the switch 30 is rendered "off." Thus, the sensing bar 29 is maintained in the vertical position as shown by the dotted line in FIG. 2 by the action of the spring 32. When the switch 30 is rendered off, the extent of shift of the slider 24 indicated on the indicating portion 35 is stored therein. On the other hand, the slider 24 is shifted towards a retracted position due to rotation of the motor 21 in the reverse direction until impinging on the stopper positioned at the reference point, so that said slider is stopped thereat. Within the electrically controlling device 34, computation is performed between the indicating portion 35 and the crushing gap setting portion 36. The difference in value is fed as signals to the pulse motor 16. Prior to adjustment, the slider 14 is shifted towards a retracted position remote from the rotor 5 due to rotation of the pulse motor 16 in a reverse direction until same impinges on the stopper positioned at the reference point and maintained in that retracted position. The signals from the electrically controlling device 34 cause rotation of the pulse motor 16, whereby the slider 14 is advanced towards the rotor 5 with the aid of the turning of the ball screw 15. Upon termination of the advancing motion of the slider 14 due to the signals, a braking action is applied by the electromagnetic brake 17 to the rotary shaft of the motor 16, whereby the operating plate 8 is held in a given position. Since the operating plate 8 is displaced towards the rotor 5 by a distance commensurate with a value given by subtracting a value of the crushing gap 10 from the shifting distance of the sensing bar 29, then the gap 10 between the operating plate 8 and the tips in wear of the striking blades is adjusted to an optimum condition.

In the embodiment shown, the operating plate 8 is displaced from its operative position towards a retracted position away from the rotor during adjustment. For this duration, the crushing by means of the operating plate 8 is suspended. This however is insignificant because the adjusting procedure is completed within only a short period of time, and hence only a small amount of uncrushed material is discharged. This gives no adverse influence on a mean grain size of crushed pieces or powder.

In order to completely eliminate interruption of the crushing, however, the following procedure may be taken. When the extent of wear of the striking blades 6 is detected by the sensing bar 29, computation is immediately performed to obtain a difference between the length of shift of the slider 24 and the length of shift of the member for detecting the extent of wear, and operating plate 8 is displaced towards the rotor by the value (distance) thus obtained. For realizing the procedure described, provision of the indefinite number of the computation parts for performing subtraction is needed. This is not difficult for those skilled in the art.

Figure 3:
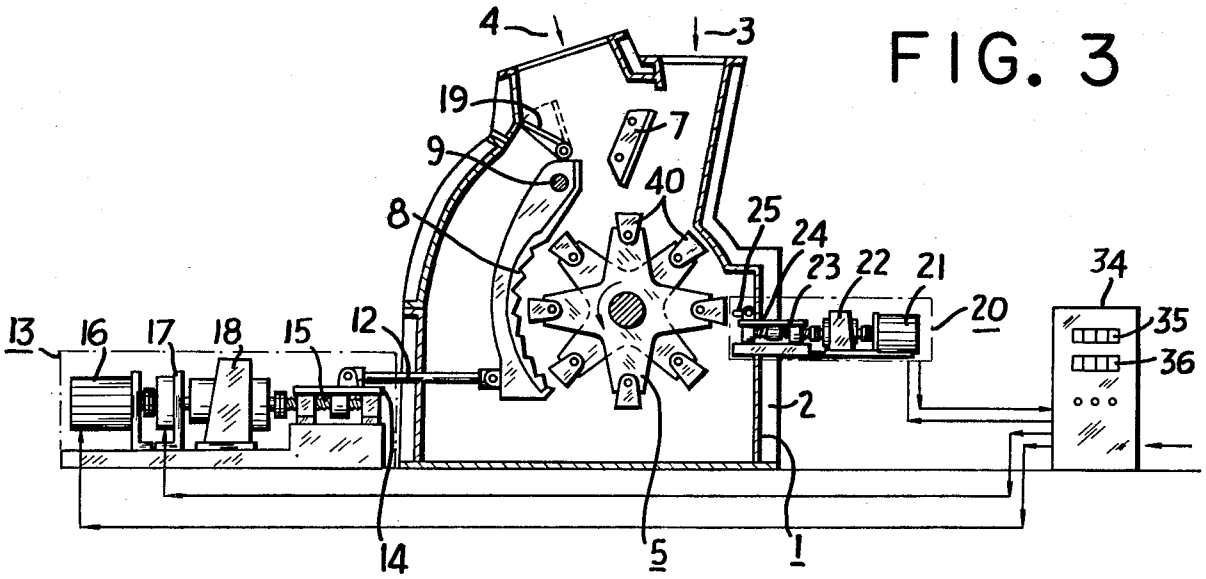
FIG. 3 is another type of crushing-drying machine embodying the present invention.

FIG. 3 shows an alternative embodiment of the crushing-drying machine embodying the present invention. Like parts to those shown in FIG. 1 are shown as having the same reference numerals. However, in FIG. 3, instead of blades there are hammers 40 mounted on a rotor 5. The hammers are pivotably mounted and therefore the arm 11 and damper spring 41 can be eliminated in this embodiment since stopping up of the materials in the gap can be prevented.

The present invention has been referred to the embodiments shown in FIGS. 1, 2 and 3, but is not limitative thereto. For example, the sensing portion 25 which is to undergo an action of the rotating striking blades or hammers may be a means utilizing a photoelectric tube, an optical means, or the like. The detecting portion 25 utilizing light, however, involves a risk of incurring error in detection, particularly due to the fact that where it is desired to crush a moisture-containing material, power or crushed pieces even after subjected to drying tend to adhere to the striking blades or hammers. From this point of view, the wear detecting portion and wear detecting method shown in FIG. 2 is advantageous in being free from error in detection, inexpensive to manufacture, and easy to maintain.

We claim:

1. A system for adjusting a gap between rotary striking blades or hammers and an operating plate in a crusher, comprising a sensing means having a sensing bar pivotally supported at one end thereof capable of shifting towards said rotary striking blades or hammers with said bar coming in contact with said blades or hammers, a means for detecting the extent of wear of said striking blades or hammers according to the extent of shift of said sensing means, and a means for moving said operating plate.

2. A system for adjusting a gap between rotary striking blades or hammers and an operating plate in a crusher comprising;

a sensing means capable of coming in contact with said rotating striking blades or hammers during service;

a means for shifting said sensing means towards said striking blades or hammers, said shifting means including a slider on which is disposed said sensing means, a ball screw threaded with said slider, and a first motor for turning said ball screw;

a converting means for converting the extent of shift of said shifting means into an extent of displacement of said operating plate, said converting means including a computer capable of calculating the difference between the extent of shift of said shifting means and an extent of displacement of said operating plate; and, a means for moving said operating plate including a connecting rod connected at one end of said operating plate, a slider supporting the other end of said connecting rod, a ball screw threaded with said slider, and a second motor for turning said last mentioned ball screw, said first and second motors respectively being electrically connected to said computing means.

3. A system as defined in claim 2, wherein said sensing means comprises a sensing bar pivotally supported at one end on a support plate rigid with said slider of said shifting means, and there is means for maintaining said sensing bar in a given position, said sensing bar being capable of contacting the striking blades or hammers when said slider of said shifting means is shifted towards the striking blades or hammers and when said sensing bar is maintained in said given position, and said sensing bar being averted from said given position immediately when contacting the rotating striking blades or hammers.

4. A system as defined in claim 3, wherein said means for maintaining said sensing bar in said given position comprises a contact switch on the support plate, and a spring confined between the mid portion of said sensing bar and the slider of said shifting means.

5. A system as defined in claim 2, further comprising two reduction gears, one disposed between the first motor and the ball screw thereof and the other between the second motor and the ball screw thereof.

6. A system as defined in claim 2, wherein said means for moving the operating plate further comprises a braking means, said braking means being electrically actuated and electrically connected to said converting means.

7. A system as defined in claim 2, wherein said crusher is a crushing-drying machine having a hot gas blast feeding port.

8. A method for adjusting a gap between striking blades or hammers and an operating plate in a crusher to a predetermined distance, said method comprising the steps of:

moving a sensing means into contact with said rotating striking blades or hammers by moving a slider provided with said sensing means towards said rotating striking blades or hammers by means of a motor mechanically coupled to said slider, while counting the distance moved by said slider from its starting point;

detecting the extent of wear of said striking blades or hammers from the total distance moved by said slider thus counted and from the total distance moved by said slider previously obtained when said gap was in said predetermined distance; and shifting said operating plate towards said striking blades or hammers by means of a motor by the distance commensurate with said extent of wear thus detected.

9. The method as recited in claim 8, wherein said step of subjecting the sensing means to undergo an action of said rotating striking blades or hammers comprises subjecting said sensing means to be brought into direct contact with said rotating striking blades or hammers.

* * * * *